US011630418B2

(12) United States Patent
Abe

(10) Patent No.: US 11,630,418 B2
(45) Date of Patent: Apr. 18, 2023

(54) IMAGE FORMING APPARATUS INCLUDING FAN CONFIGURED TO INTRODUCE AIR TOWARD AIR BLOW TARGET

(71) Applicant: BROTHER KOGYO KABUSHIKI KAISHA, Nagoya (JP)

(72) Inventor: Koji Abe, Okazaki (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 17/583,590

(22) Filed: Jan. 25, 2022

(65) Prior Publication Data

US 2022/0244678 A1 Aug. 4, 2022

(30) Foreign Application Priority Data

Jan. 29, 2021 (JP) ..... JP2021-012560

(51) Int. Cl.
*G03G 21/00* (2006.01)
*G03G 21/20* (2006.01)

(52) U.S. Cl.
CPC ... *G03G 21/206* (2013.01); *G03G 2221/1645* (2013.01)

(58) Field of Classification Search
CPC ..... G03G 21/206; G03G 2221/1645; H02B 1/56; H05K 7/20136; F24F 2013/205
USPC ..... 399/92; 312/236; 361/678, 679.48, 695; 454/254
See application file for complete search history.

(56) References Cited

U.S. PATENT DOCUMENTS

2016/0209806 A1* 7/2016 Shiomi ..... G03G 21/206
2016/0291541 A1* 10/2016 Yamashita ..... G03G 21/206
2017/0153598 A1* 6/2017 Satou ..... G03G 21/206
2021/0096511 A1* 4/2021 Okawa ..... G03G 21/206

FOREIGN PATENT DOCUMENTS

JP 2016-224147 A 12/2016

* cited by examiner

*Primary Examiner* — Robert B Beatty
(74) *Attorney, Agent, or Firm* — Merchant & Gould P.C.

(57) ABSTRACT

A fan introduces air and send the air toward an air blow target. The fan includes an impeller and a casing. The casing includes a first wall covering the impeller, a second wall covering the impeller and facing the first wall, and a peripheral wall surrounding the impeller and connecting the first and second walls. The peripheral wall has an air discharge port for discharging air toward the air blow target. The impeller is located between the first wall and the second wall. The second wall is located closer to a side cover than the first wall is. At least the first wall or the second wall has an air inlet port for introducing air into the casing. The outside air inlet is located at a different position from the air inlet port as viewed from a facing direction in which the fan and the side cover face each other.

18 Claims, 7 Drawing Sheets

IMAGE FORMING APPARATUS INCLUDING FAN CONFIGURED TO INTRODUCE AIR TOWARD AIR BLOW TARGET

CROSS REFERENCE TO RELATED APPLICATIONS

This application claims priority from Japanese Patent Application No. 2021-012560 filed Jan. 29, 2021. The entire content of the priority application is incorporated herein by reference.

BACKGROUND

An image forming apparatus includes a housing and a fan. The housing has an exterior portion that is a side cover. The exterior portion has a louver for introducing outside air. The housing accommodates an image forming unit. The fan is arranged in the housing so as to face the exterior portion. The fan takes in air and blows the air toward the image forming unit.

SUMMARY

According to one aspect, this specification discloses an image forming apparatus. The image forming apparatus includes a housing and a fan. The housing includes a side cover having an outside air inlet. The housing accommodates an air blow target. The fan is disposed to face the side cover in the housing. The fan is configured to introduce air and send the air toward the air blow target. The fan includes an impeller and a casing. The casing includes a first wall covering the impeller, a second wall covering the impeller and facing the first wall, and a peripheral wall surrounding the impeller and connecting the first wall with the second wall. The peripheral wall has an air discharge port for discharging air toward the air blow target. The impeller is located between the first wall and the second wall. The second wall is located closer to the side cover than the first wall is. At least the first wall or the second wall has an air inlet port for introducing air into the casing. The outside air inlet is located at a different position from the air inlet port as viewed from a facing direction in which the fan and the side cover face each other.

In the image forming apparatus of this disclosure, the outside air inlet is located at a position different from the air inlet port when viewed from the facing direction. With this configuration, even if the rotation noise of the impeller of the fan leaks from the air inlet port, most of the leaked rotation noise is easily blocked by the casing and the wall surrounding the outside air inlet in the side cover, and the noise does not leak much to the outside of the housing through the outside air inlet.

Therefore, the image forming apparatus of this disclosure suppresses noise caused by a fan.

BRIEF DESCRIPTION OF THE DRAWINGS

Embodiments in accordance with this disclosure will be described in detail with reference to the following figures wherein.

DETAILED DESCRIPTION

In the above-mentioned image forming apparatus, the fan has an impeller and a casing. The casing has a first wall that covers the impeller, a second wall that covers the impeller, and a peripheral wall that surrounds the impeller and connects the first wall and the second wall.

The impeller is located between the first wall and the second wall. The second wall is closer to the exterior portion than the first wall is. The second wall has an air inlet port for taking in air. The first wall has an air outlet port for discharging air toward the image forming unit. The outside air inlet is located at a position overlapping the entirety of the air inlet port as viewed from the facing direction in which the fan and the exterior portion face each other.

In the above-mentioned image forming apparatus, the rotation noise of the impeller of the fan tends to leak to the outside of the housing through the air inlet port and the louver, and as a result, it is difficult to suppress the noise caused by the fan.

In view of the foregoing, an aspect of an object of this disclosure is to provide an image forming apparatus configured to suppress noise caused by a fan.

Hereinafter, an embodiment of this disclosure will be described with reference to the drawings.

As shown in FIGS. 1 to 5, an image forming apparatus 1 of the embodiment is an example of the image forming apparatus of this disclosure. The image forming apparatus 1 is a laser printer that forms an image on a sheet SH by an electrophotographic method.

Figure 1:
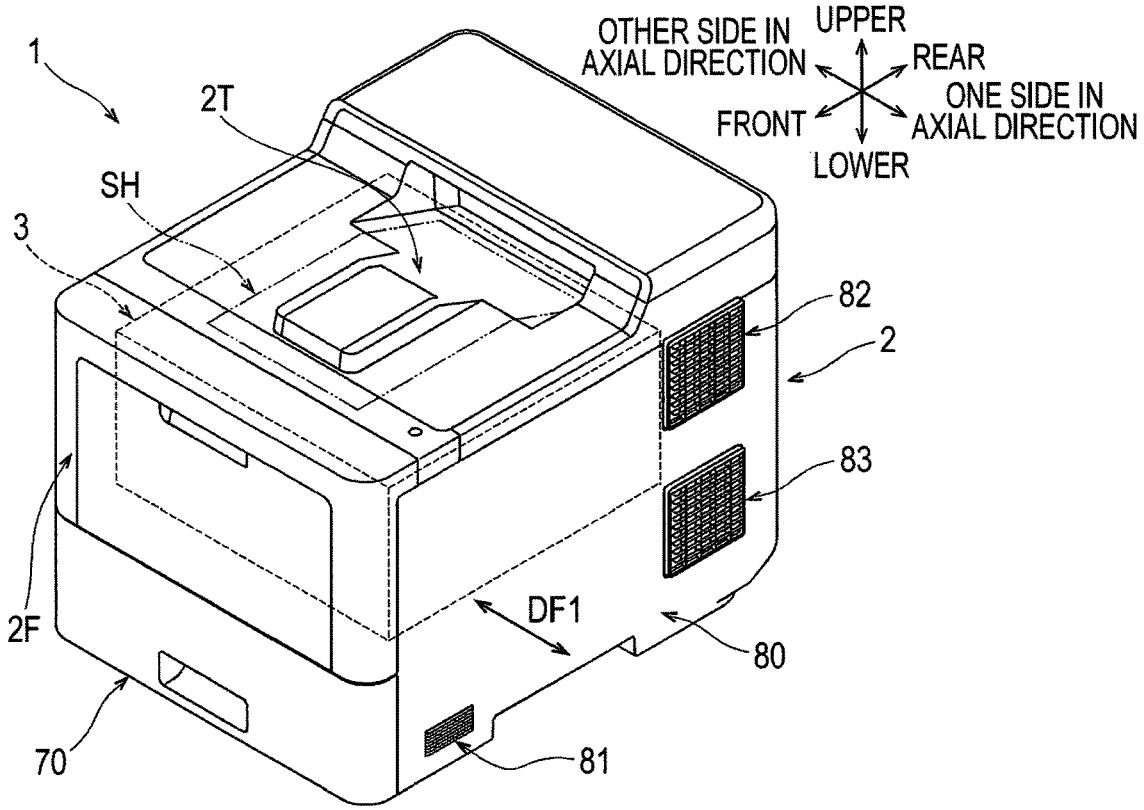
FIG. 1 is a perspective view of an image forming apparatus.

As shown in FIG. 1, the image forming apparatus 1 includes a housing 2, a sheet tray 70, and an image forming unit 3.

The housing 2 is a substantially box-shaped body having a front cover 2F, a discharge tray 2T, and a side cover 80. The housing 2 accommodates the image forming unit 3 and the sheet tray 70.

Figure 5:
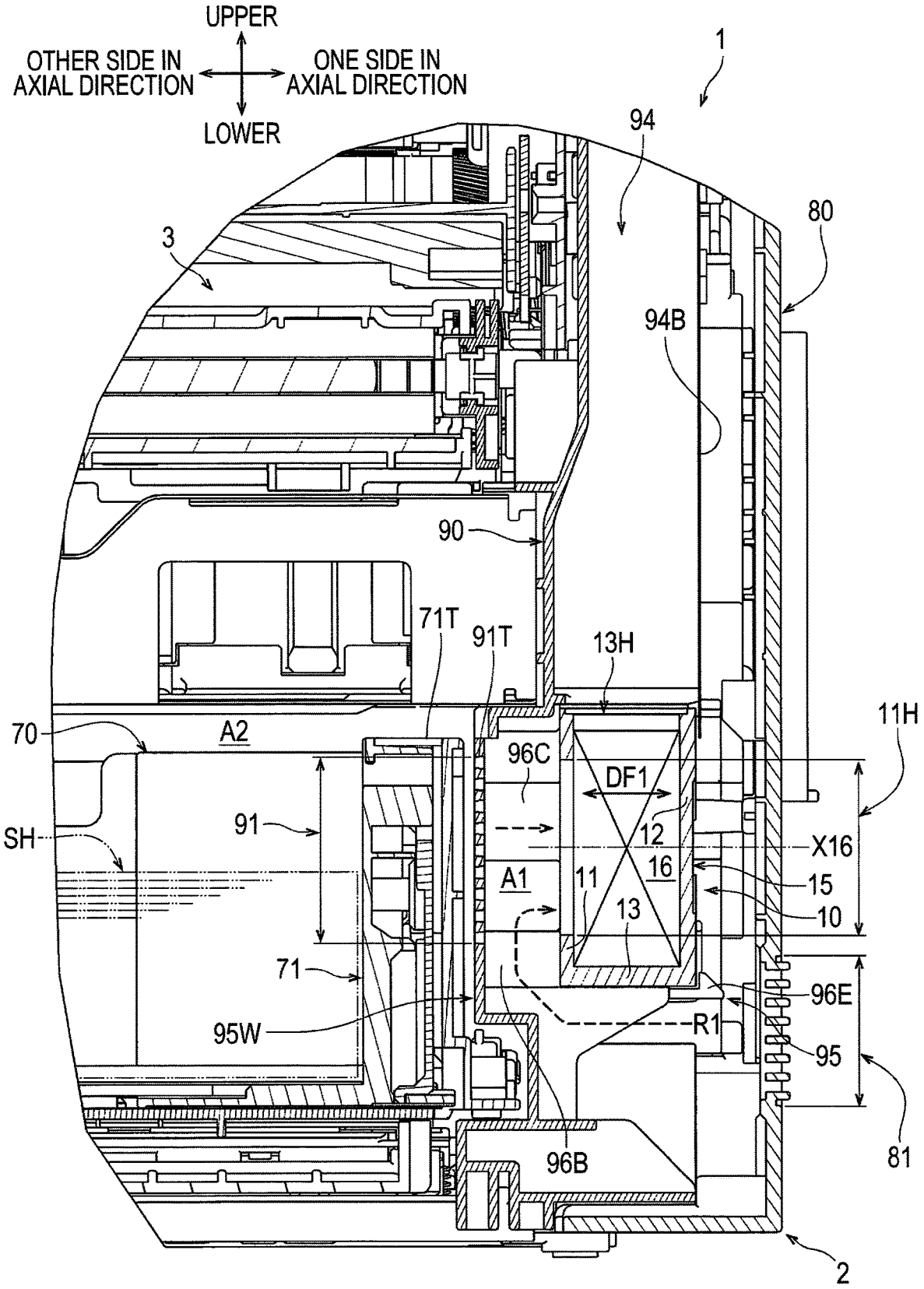
FIG. 5 is a partial cross-sectional view showing a cross section taken along a line A-A of FIG. 3.

As shown in FIG. 5, the sheet tray 70 is located at the bottom in the housing 2. The sheet tray 70 is a substantially box-shaped body with an open upper part, and accommodates the sheet SH before image formation in a stacked state. As shown in FIG. 1, the front surface of the sheet tray 70 constitutes the front surface of the image forming apparatus 1 together with the front cover 2F.

The image forming unit 3 is located above the sheet tray 70 in the housing 2. Although the specific configuration will be described later, the image forming unit 3 forms an image on the sheet SH conveyed from the sheet tray 70.

The discharge tray 2T is located at the upper surface of the housing 2. The discharge tray 2T supports the sheet SH on which the image is formed by the image forming unit 3.

Figure 2:
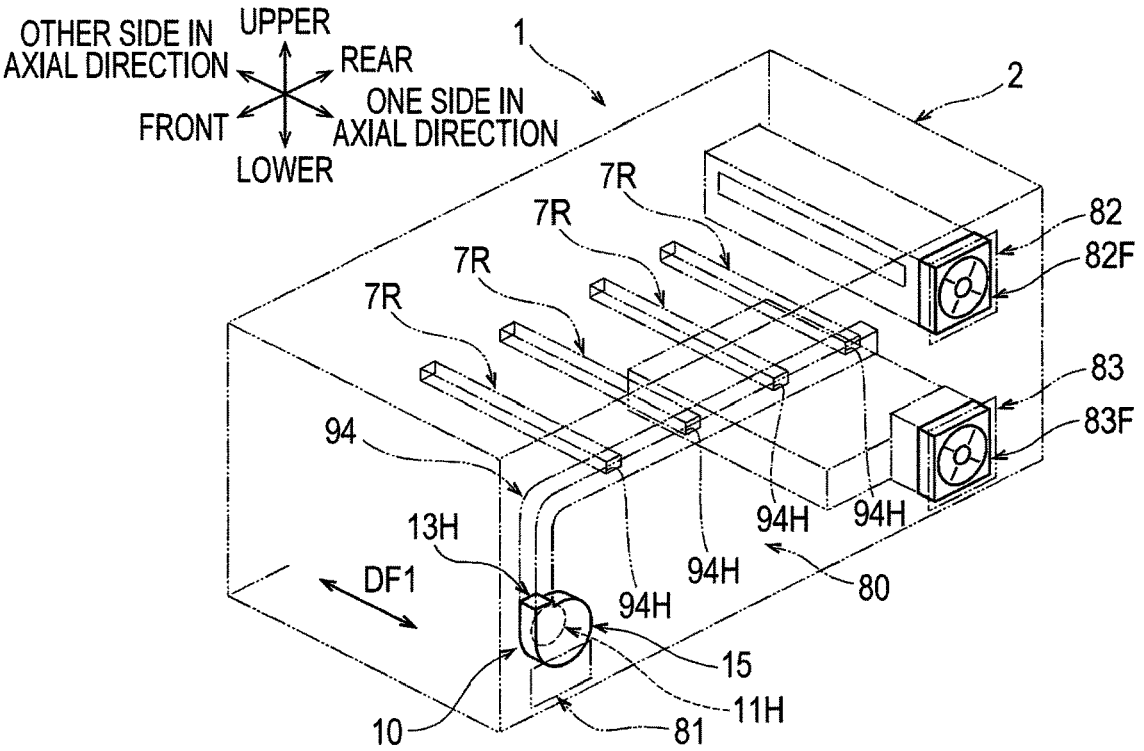
FIG. 2 is a schematic perspective view showing a blower fan, a first air discharge fan, a second air discharge fan, an air duct, and so on, in a housing.
Figure 3:
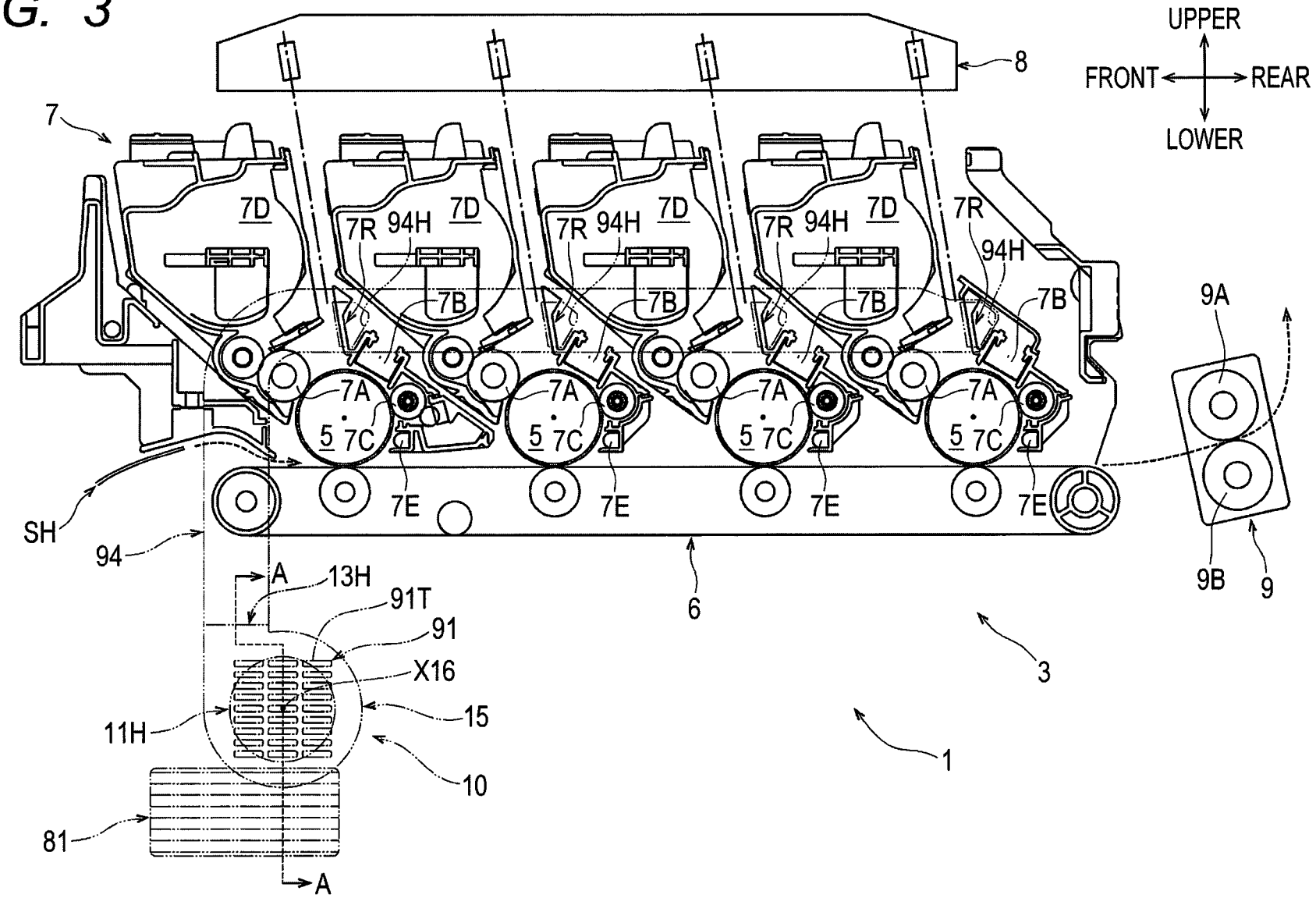
FIG. 3 is a partial side view showing an image forming unit and so on, and is a diagram for explaining the positional relationship between the image forming unit, an air inlet port, the blower fan, and the air duct.

The front-rear direction and the upper-lower direction shown in FIG. 2 and thereafter correspond to FIG. 1. Further, as shown in FIG. 1 and so on, the axial direction of the photosensitive drum perpendicular to the front-rear direction and the upper-lower direction is a direction in which the axis of a photosensitive drum 5 constituting a part of the image forming unit 3 extends as shown in FIG. 3.

As shown in FIG. 1, the side cover 80 is located at one side of the axial direction of the photosensitive member (hereinafter, simply referred to as "axial direction") in the housing 2, and extends in a substantially flat plate shape in the front-rear direction and the upper-lower direction. The side cover 80 constitutes one side surface of the image forming apparatus 1.

Figure 4:
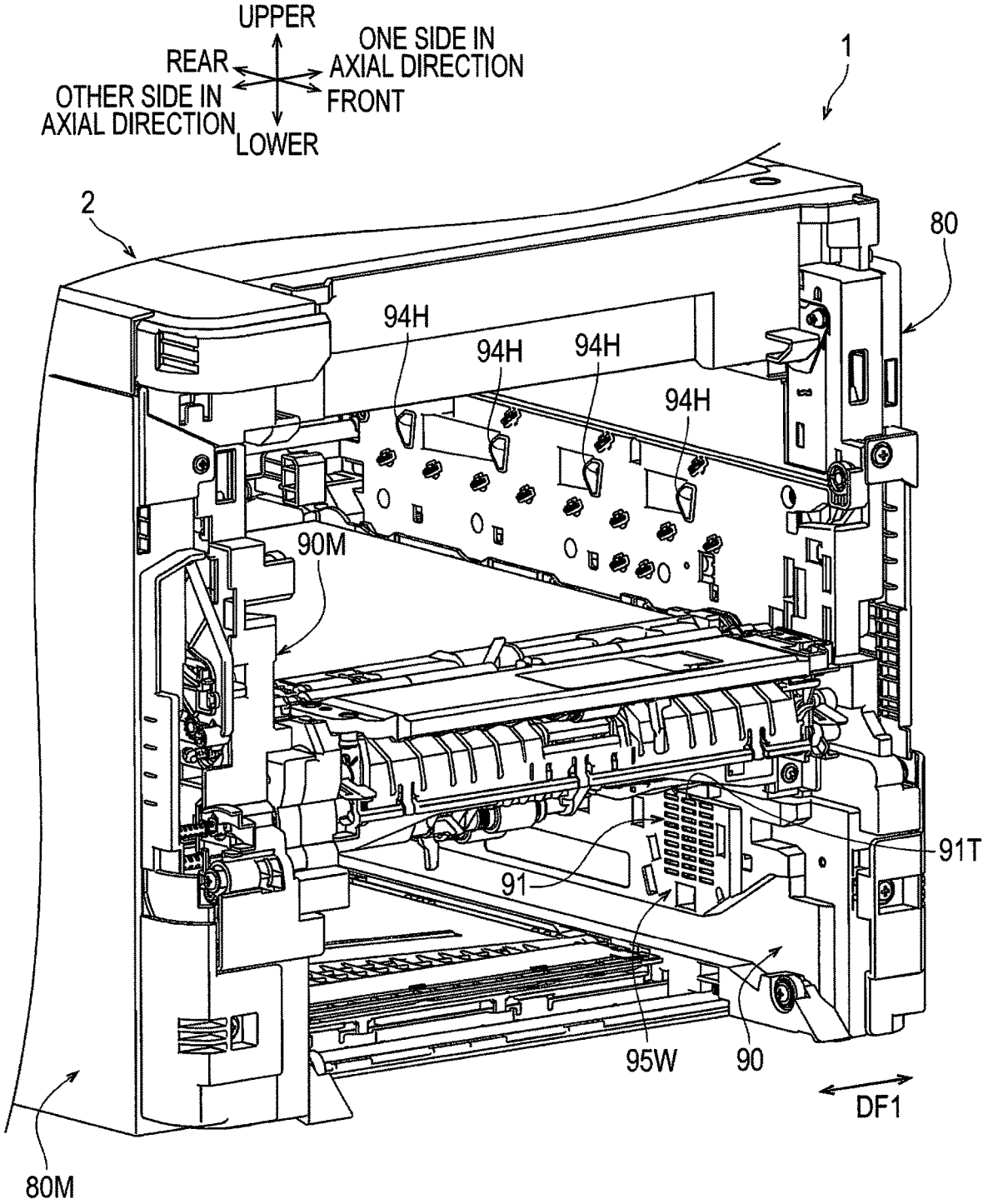
FIG. 4 is a partial perspective view showing the front part of the housing, showing a state where a front cover, a process cartridge, and a sheet tray are removed.

As shown in FIG. 4, the housing 2 also includes a side cover 80M. The side cover 80M is located at the other side of the housing 2 in the axial direction, and extends in a substantially flat plate shape in the front-rear direction and the upper-lower direction. The side cover 80M constitutes the other side surface of the image forming apparatus 1.

As shown in FIGS. 4 to 7, the image forming apparatus 1 includes a frame 90. The frame 90 is located at the one side of the housing 2 in the axial direction. The frame 90 extends in the front-rear direction and the upper-lower direction, and has a plurality of reinforcing walls, ribs, protrusions, holes, and so on.

In this embodiment, the frame 90 is a resin molded product manufactured by injection molding of a thermoplastic resin and so on.

As shown in FIG. 5, the frame 90 supports the side cover 80 in a state where the frame 90 is covered with the side cover 80. The frame 90 faces the side cover 80 in a facing direction DF1 parallel to the axial direction.

As shown in FIG. 4, the image forming apparatus 1 also includes a frame 90M. The frame 90M is located at the other side of the housing 2 in the axial direction. The frame 90M also extends in the front-rear direction and the upper-lower direction, and has a plurality of reinforcing walls, ribs, protrusions, holes, and so on. The frame 90M supports the side cover 80M in a state where the frame 90M is covered with the side cover 80M.

The frame 90 and the frame 90M are connected by a plurality of connecting members extending in the axial direction. The frame 90 and the frame 90M support the sheet tray 70 so as to be pulled out forward from the housing 2. Thus, the sheet tray 70 is detachable from the housing 2.

<Image Forming Unit>

As shown in FIG. 3, the image forming unit 3 is of a direct transfer type color electrophotographic system. The image forming unit 3 includes a process cartridge 7, a transfer belt 6, a scanner unit 8, a fixing unit 9, and so on, which are well-known configurations.

The process cartridge 7 corresponds to toner of four color of black, yellow, magenta, and cyan, and includes four cartridges arranged in series in the front-rear direction.

The frame 90 and the frame 90M support the process cartridge 7 so as to be pulled out forward from the housing 2. Thus, as shown in FIG. 4, the process cartridge 7 is detachable from the housing 2.

As shown in FIG. 3, the process cartridge 7 includes four sets of a photosensitive member 5, a toner storage portion 7D, a development roller 7A, a charger 7B, a cleaning roller 7C, an erase laser 7E, and so on, corresponding to each color of toner.

Each photosensitive member 5 has a cylindrical shape and is rotatable about the axis of the photosensitive member. A positively charged photosensitive layer is formed on the surface of each photosensitive member 5.

Each toner storage portion 7D is located at a higher and farther forward position than the corresponding photosensitive member 5. Each toner storage portion 7D internally stores toner of a corresponding color. Each toner storage portion 7D rotatably supports the corresponding development roller 7A at the lower end thereof. Each development roller 7A supplies toner in each toner storage portion 7D to each photosensitive member 5.

Each charger 7B faces the corresponding photosensitive member 5 from above and rear. Each charger 7B positively charges the surface of the corresponding photosensitive member 5 in a non-contact manner by a grid electrode extending in the axial direction.

Each cleaning roller 7C is in contact with the corresponding photosensitive member 5 from rear. Each cleaning roller 7C removes excess toner adhering to the corresponding photosensitive member 5.

Each erase laser 7E is located below the corresponding cleaning roller 7C and faces the corresponding photosensitive member 5 from rear. Each erase laser 7E irradiates the corresponding photosensitive member 5 with a laser beam and erases the electric charge remaining on the surface of the photosensitive member 5.

The transfer belt 6 faces each photosensitive member 5 from below. The transfer belt 6 circularly moves while sandwiching the sheet SH conveyed from the sheet tray 70 with each photosensitive member 5.

The scanner unit 8 is arranged above the process cartridge 7. The scanner unit 8 has a laser light source, a polygon mirror, an fθ lens, a reflecting mirror, and so on. The scanner unit 8 irradiates each photosensitive member 5 with a laser beam from above.

The fixing unit 9 is located farther rearward than the process cartridge 7. The fixing unit 9 includes a heating roller 9A and a pressure roller 9B. The fixing unit 9 heats and pressurizes the sheet SH that has passed below the process cartridge 7 by sandwiching the sheet SH between the heating roller 9A and the pressure roller 9B.

The image forming unit 3 forms an image on the sheet SH conveyed from the sheet tray 70 as follows. The surface of each photosensitive member 5 is uniformly positively charged by each charger 7B as the photosensitive member 5 rotates, and then exposed by high-speed scanning of a laser beam emitted from the scanner unit 8. With this operation, an electrostatic latent image corresponding to the image to be formed on the sheet SH is formed on the surface of each photosensitive member 5. Next, toner is supplied from each toner storage portion 7D to the surface of each photosensitive member 5 corresponding to the electrostatic latent image. The toner borne on the surface of the photosensitive member 5 is transferred to the sheet SH. Then, the sheet SH is heated and pressurized in the fixing unit 9 so that the transferred image is thermally fixed, and then the sheet SH is discharged to the discharge tray 2T.

The image forming apparatus 1 has the configuration described below in order to remove heat accumulated in the photosensitive member 5, the development roller 7A, the charger 7B and its vicinity, ozone generated in the charger 7B, and so on.

The photosensitive member 5, the development roller 7A, and the charger 7B are examples of the "air blow target" of this disclosure. Further, components located in the vicinity of the photosensitive member 5, the development roller 7A, and the charger 7B, such as the cleaning roller 7C and the erase laser 7E are also included in an example of the "air blow target" of this disclosure.

<Outside Air Inlet, First Outlet Port and Second Outlet Port>

As shown in FIG. 1, the side cover 80 has an outside air inlet 81, a first outlet port 82, and a second outlet port 83. The outside air inlet 81, the first outlet port 82, and the second outlet port 83 are rectangular openings having vertical and horizontal grids, and penetrate the side cover 80 in the axial direction.

The first outlet port 82 is located near the rear and upper corner of the side cover 80. The second outlet port 83 is located near the rear and lower corner of the side cover 80.

The outside air inlet 81 is located near the front and lower corner of the side cover 80. Since the outside air inlet 81 shown in FIG. 3 is located at the near side of the drawing surface, that is, at the one side in the axial direction, with respect to the image forming unit 3 and the transfer belt 6, it is indicated by a two-dot chain line. As shown in FIGS. 3 and 5, the outside air inlet 81 is located at a position separated downward from the image forming unit 3.

<First Air Discharge Fan and Second Air Discharge Fan>

As shown in FIG. 2, the image forming apparatus 1 includes a first air discharge fan 82F and a second air discharge fan 83F. The first air discharge fan 82F and the second air discharge fan 83F are axial fans each having an impeller that rotates about a rotation axis extending in the axial direction.

Figure 6:
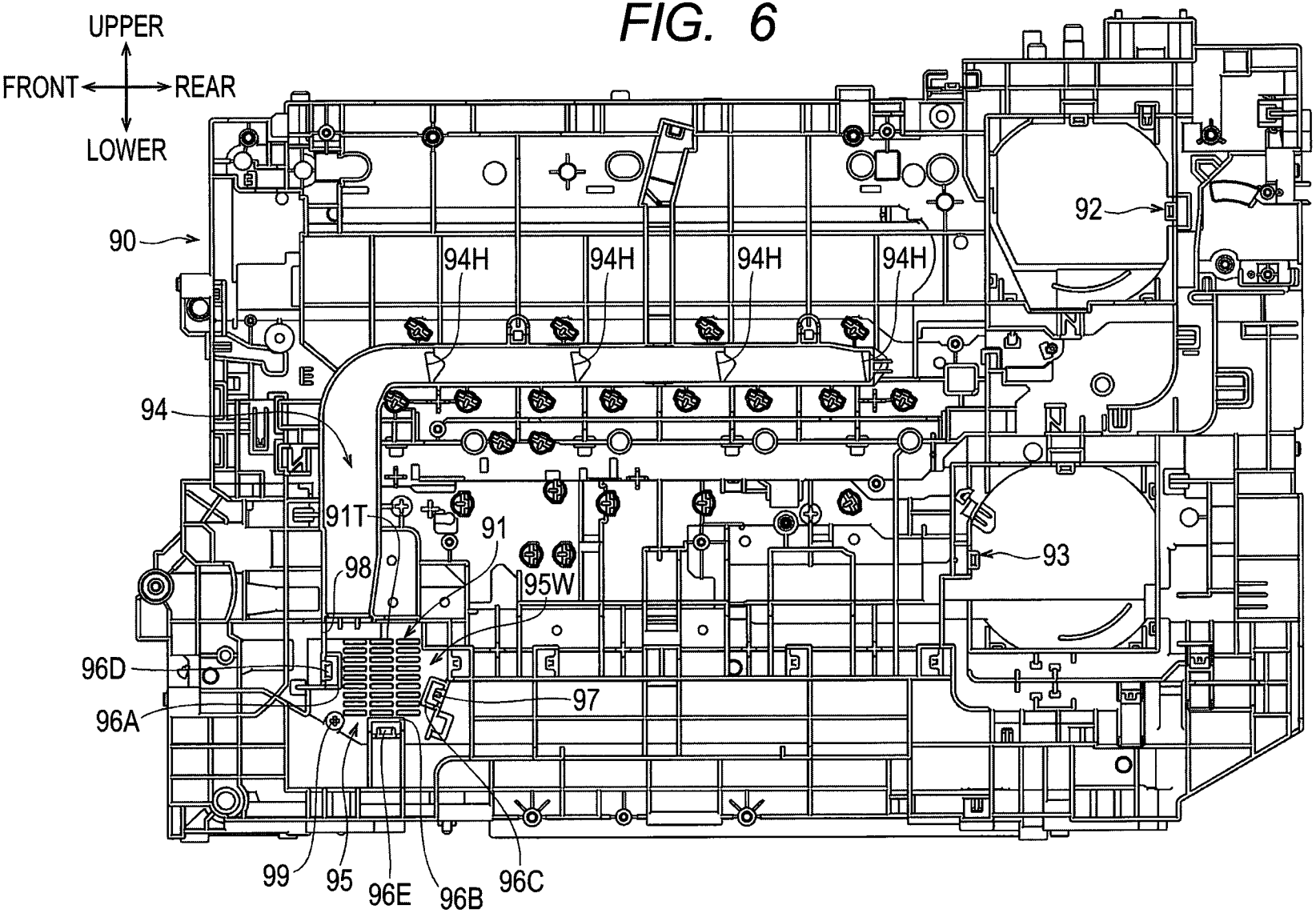
FIG. 6 is a side view of a frame, showing a state before attaching the blower fan.

The first air discharge fan 82F is held by a first air discharge fan holding portion 92 of the frame 90 shown in FIG. 6, so that the first air discharge fan 82F overlaps the first outlet port 82 in the housing 2 as shown in FIG. 2.

The second air discharge fan 83F is held by a second air discharge fan holding portion 93 of the frame 90 shown in FIG. 6, so that the second air discharge fan 83F overlaps the second outlet port 83 in the housing 2 as shown in FIG. 2.

The first air discharge fan 82F and the second air discharge fan 83F discharge the air in the housing 2 to the outside through the first outlet port 82 and the second outlet port 83, and generate a negative pressure region at the rear side inside the housing 2.

<Blower Fan>

As shown in FIGS. 2, 3, 5, and 7 to 9, the image forming apparatus 1 includes the blower fan 10. The blower fan 10 is an example of a "fan". In the description of the shape and so on of the blower fan 10, the front-rear direction, the upper-lower direction, and the axial direction are used with reference to the state in which the blower fan 10 is assembled to the frame 90 as shown in FIG. 5 and so on.

Figure 7:
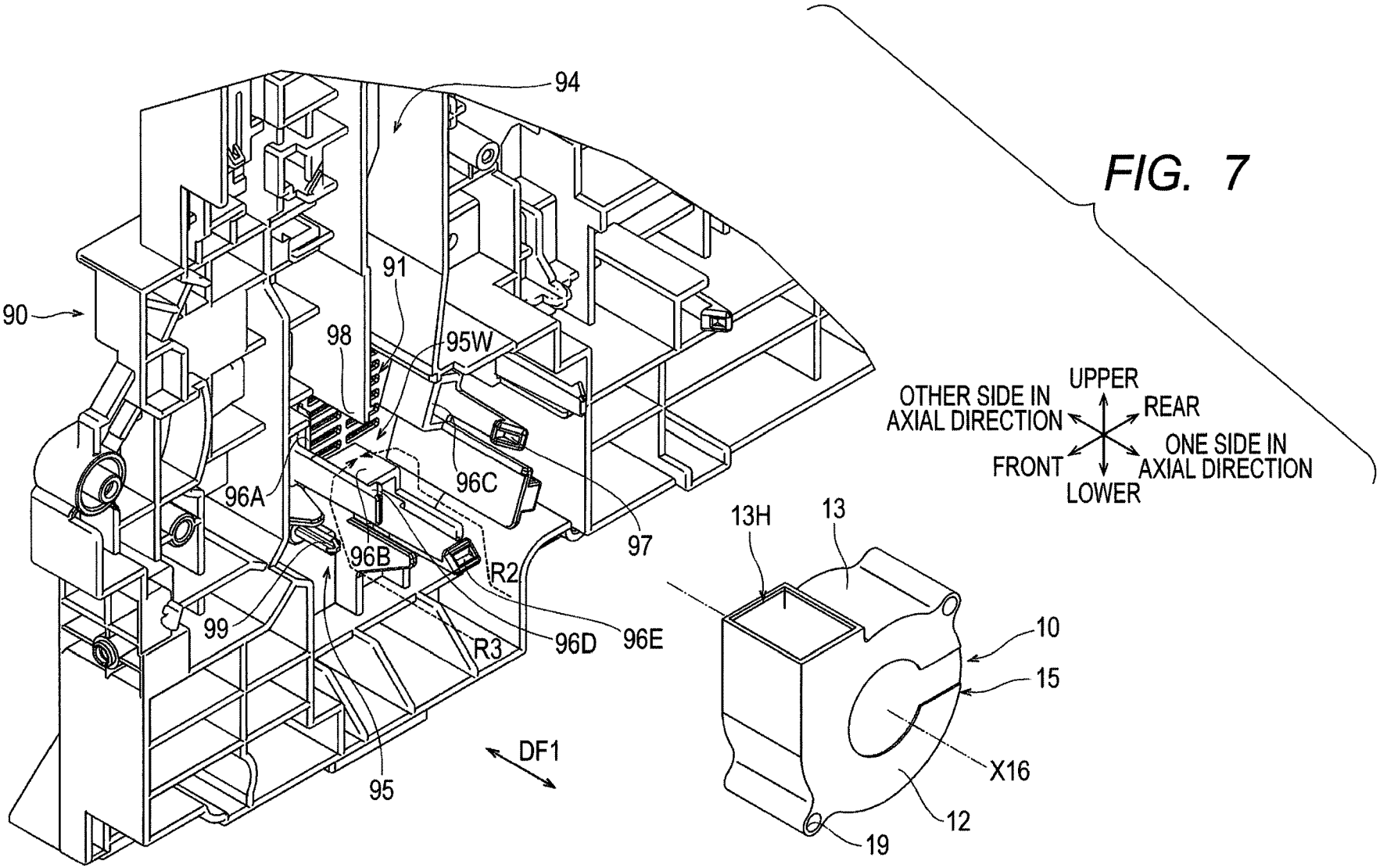
FIG. 7 is a partial perspective view of the frame, showing a state before attaching the blower fan.
Figure 8:
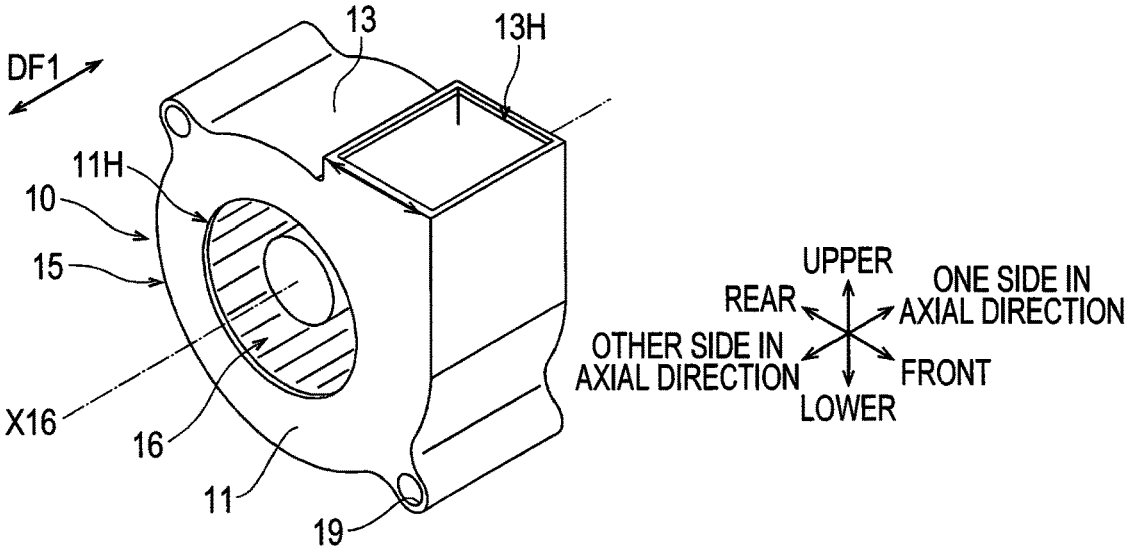
FIG. 8 is a perspective view of the blower fan.

As shown in FIGS. 7 and 8, the blower fan 10 is a so-called sirocco fan, and has an impeller 16 and a casing 15. The blower fan 10 has a drive motor and a power supply wire (not shown).

As shown in FIG. 8, the impeller 16 is fixed to a drive shaft of a drive motor (not shown) and rotates about a rotation axis X16 parallel to the axial direction. The impeller 16 has a plurality of blades. Each blade extends long and thin parallel to the rotation axis X16, and are arranged in a cylindrical shape in which the rotation axis X16 is the center.

The casing 15 has a first wall 11, a second wall 12, and a peripheral wall 13. The first wall 11 has a substantially disk shape and covers the impeller 16 from the other side in the axial direction. As shown in FIG. 7, the second wall 12 also has a substantially disk shape, covers the impeller 16 from the one side in the axial direction, and holds a drive motor (not shown). That is, the impeller 16 is located between the first wall 11 and the second wall 12 in the axial direction.

The peripheral wall 13 has a substantially cylindrical shape in which the rotation axis X16 is the center, and surrounds the impeller 16. The edge of the peripheral wall 13 at the other side in the axial direction is connected to the outer peripheral edge of the first wall 11. The edge of the peripheral wall 13 at the one side in the axial direction is connected to the outer peripheral edge of the second wall 12.

As shown in FIG. 8, the first wall 11 has an air inlet port 11H. The air inlet port 11H is a circular hole in which the rotation axis X16 is the center. The air inlet port 11H takes in air toward a low pressure region generated at the inner peripheral side of the impeller 16 in the casing 15. On the other hand, as shown in FIG. 7, the second wall 12 does not have an air inlet port.

The peripheral wall 13 has an air discharge port 13H in a portion located at the front and upper sides thereof. The air discharge port 13H has a square cylinder shape that protrudes upward. The air discharge port 13H discharges the air accumulated in a high pressure region generated at the outer peripheral side of the impeller 16 in the casing 15.

The peripheral wall 13 has a positioning hole 19 in a portion located at the front and lower sides thereof. The positioning hole 19 is a circular hole formed to penetrate, in the axial direction, a convex portion protruding in the outward radial direction of the rotation axis X16 from the outer cylinder surface of the peripheral wall 13.

<Fan Holding Portion>

As shown in FIGS. 5, 6, 7, and 9, the image forming apparatus 1 includes a fan holding portion (fan holder) 95. The fan holding portion 95 is formed integrally with the frame 90.

As shown in FIGS. 5 and 7, the frame 90 has a facing wall 95W including a portion facing the outside air inlet 81 of the side cover 80 in the facing direction DF1 and a portion located above the outside air inlet 81. As shown in FIGS. 6 and 7, the facing wall 95W does not have a plurality of reinforcing ribs crossing in a grid pattern.

The fan holding portion 95 has a positioning shaft 99, seats 96A, 96B, and 96C, a positioning contact rib 98, an urging portion 97, and retaining portions 96D and 96E which are formed integrally with the facing wall 95W.

The positioning shaft 99 is a shaft that protrudes from the facing wall 95W toward the one side in the axial direction. The protruding length and outer diameter of the positioning shaft 99 are set to such sizes that the shaft fits into the positioning hole 19.

The seat 96A protrudes from the facing wall 95W toward the one side in the axial direction at a position separated upward from the positioning shaft 99. The seat 96B protrudes from the facing wall 95W toward the one side in the axial direction at a position separated rearward from the positioning shaft 99. The seat 96C protrudes from the facing wall 95W toward the one side in the axial direction at a position separated upward and rearward from the positioning shaft 99.

The positioning contact rib 98 is a rib that protrudes from the facing wall 95W toward the one side in the axial direction at the upper side of the seat 96A and extends in the upper-lower direction.

The urging portion 97 protrudes long and thin from the tip end of the seat 96B toward the one side in the axial direction, and the tip is bent like a claw. That is, the urging portion 97 is an urging protrusion protruding from the main body of the frame 90. The retaining portion 96D protrudes long and thin from the tip end of the seat 96A toward the one side in the axial direction, and the tip is bent like a claw. The retaining portion 96E protrudes long and thin from the tip end of the seat 96C toward the one side in the axial direction, and the tip is bent like a claw.

The protruding length of the urging portion 97 is set shorter than the protruding length of the retaining portions 96D and 96E so that the tip of the urging portion 97 contacts the peripheral wall 13.

Figure 9:
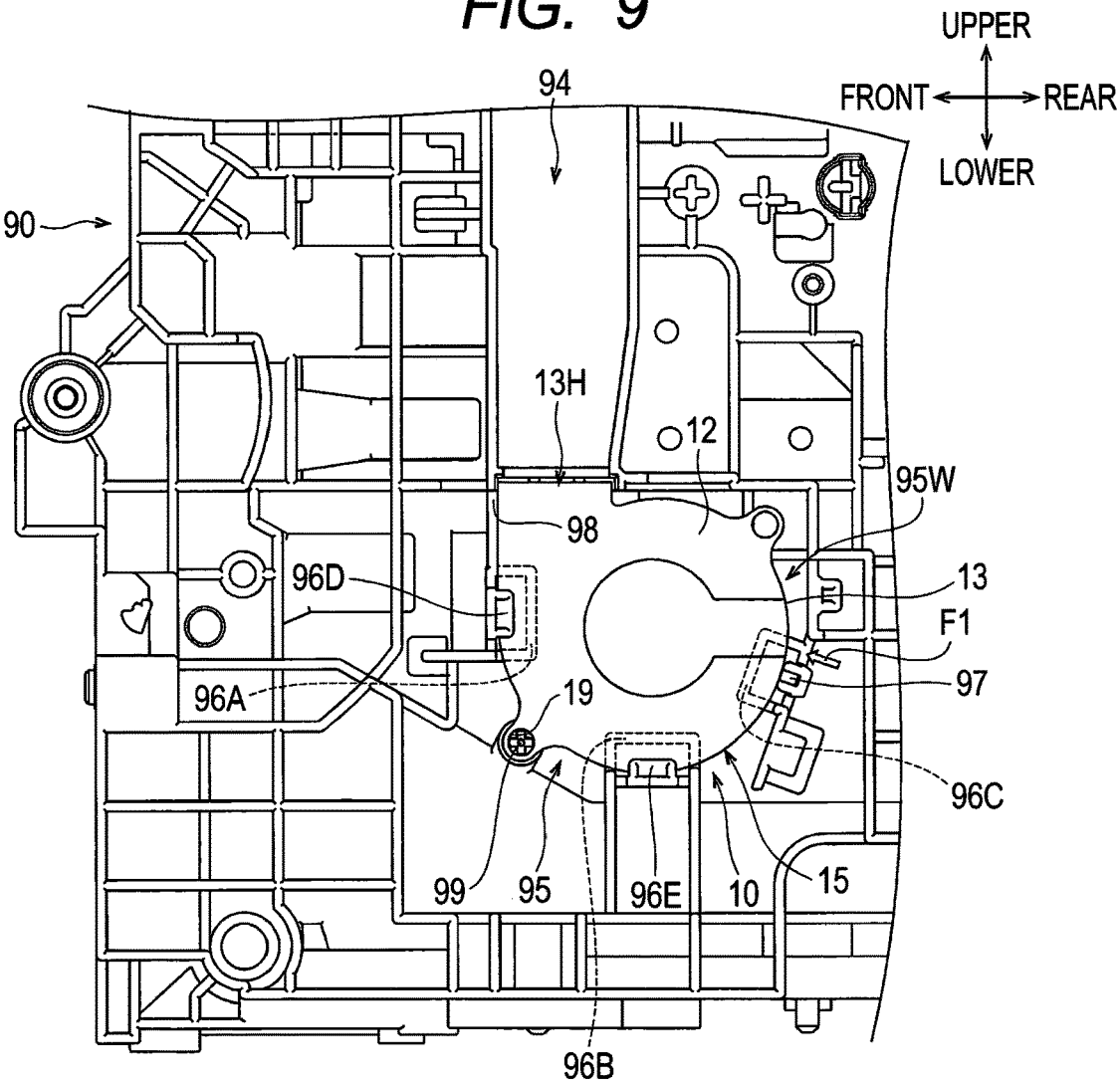
FIG. 9 is a partial side view of the frame, showing a state where the blower fan is attached.

In the assembly process, the operator moves the blower fan 10 from the position shown in FIG. 7 toward the other side in the axial direction, and as shown in FIG. 9, the positioning shaft 99 is fitted into the positioning hole 19.

Then, as shown in FIG. 5, the seats 96A, 96B, and 96C contact the first wall 11 at a position separated from the facing wall 95W toward the one side in the axial direction to position the casing 15 in the facing direction DF1.

As shown in FIGS. 5 and 9, the retaining portions 96D and 96E retain the casing 15 in the facing direction DF1 by the claws engaging with the outer peripheral edge of the second wall 12.

As shown in FIG. 9, the positioning contact rib 98 contacts the peripheral wall 13 at a position separated upward from the positioning shaft 99 to position the casing 15 around the positioning shaft 99.

At this time, the urging portion 97 contacts the peripheral wall 13 while being elastically deformed at a position separated rearward from the positioning shaft 99 and the positioning contact rib 98 to urge the casing 15 toward the positioning contact rib 98 with urging force F1.

In this way, the fan holding portion 95 holds the blower fan 10 in the housing 2, as shown in FIG. 5. The blower fan 10 is arranged so as to face the side cover 80 in the facing direction DF1. In this state, the second wall 12 is located closer to the side cover 80 than the first wall 11 is. The air inlet port 11H of the first wall 11 is open so as to face the side opposite to the side cover 80.

As shown in FIGS. 3 and 5, the outside air inlet 81 is located at a position different from the air inlet port 11H when viewed from the facing direction DF1 where the blower fan 10 and the side cover 80 face each other. More specifically, the outside air inlet 81 is located at a lower position than the air inlet port 11H and does not overlap the entire air inlet port 11H.

A part of the casing 15 located below the air inlet port 11H overlaps the outside air inlet 81 when viewed from the facing direction DF1. In other words, the lower end of the second wall 12 of the casing 15 is located at a lower position than the upper end of the outside air inlet 81. As shown in FIG. 3, the air inlet port 11H in the front-rear direction is located at a position overlapping the outside air inlet 81.

<Communication Port>

As shown in FIG. 5, the facing wall 95W of the frame 90 is located between the sheet tray 70 and the blower fan 10 in the housing 2. As shown in FIGS. 4 to 7, the facing wall 95W has a communication port 91.

As shown in FIGS. 6 and 7, the communication port 91 is located in a region of the facing wall 95W surrounded by the positioning shaft 99, the seats 96A, 96B, and 96C and the positioning contact rib 98. The communication port 91 is a rectangular opening having vertical and horizontal grids, and is formed to penetrate the facing wall 95W in the axial direction.

As shown in FIGS. 3 and 5, the entire communication port 91 is located at a position overlapping the casing 15 when viewed from the facing direction DF1. The most part of the communication port 91 is located at a position overlapping the air inlet port 11H when viewed from the facing direction DF1.

As shown in FIG. 5, the communication port 91 allows communication between a space A2 located at the sheet tray 70 side with respect to the frame 90 and a space A1 located at the blower fan 10 side with respect to the frame 90.

An upper end 71T of the tray side wall 71 of the sheet tray 70 facing the frame 90 is located at a higher position than an upper end 91T of the communication port 91.

<Air Duct>

As shown in FIGS. 5, 6, 7, and 9, the image forming apparatus 1 includes an air duct 94. The air duct 94 is formed integrally with the frame 90, and is covered by a duct cover 94B shown in FIG. 5 from the one side in the axial direction.

As shown in FIGS. 5 and 9, the lower end of the air duct 94 is connected to the air discharge port 13H of the blower fan 10. As shown in FIG. 6, the air duct 94 extends upward from the lower end thereof, then changes its direction, and extends rearward.

As shown in FIGS. 4 and 6, the air duct 94 has four duct outlet ports 94H. The duct outlet ports 94H are arranged in the front-rear direction in the portion of the air duct 94 extending rearward, and formed to penetrate the frame 90 in the axial direction.

As shown in FIGS. 2 and 3, the process cartridge 7 has four flow passages 7R. Each flow passage 7R extends in the axial direction at a position at the front and upper side of the corresponding charger 7B. Each duct outlet port 94H communicates with an end of each flow passage 7R at the one side in the axial direction.

As shown in FIG. 5, when the drive motor (not shown) operates and the impeller 16 rotates, the blower fan 10 takes in the air introduced into the space A1 in the housing 2 from the outside through the outside air inlet 81, into the casing 15, through the air inlet port 11H.

At this time, as indicated by arrow R1 shown as an example in FIG. 5 and arrows R2 and R3 shown as an example in FIG. 7, the air introduced into the space A1 in the housing 2 through the outside air inlet 81 smoothly reaches the space between the facing wall 95W and the first wall 11 by flowing through the space between the positioning shaft 99, the seats 96A, 96B, and 96C, the positioning contact rib 98, the urging portion 97, and the retaining portions 96D and 96E while circumventing the second wall 12 and the peripheral wall 13 of the casing 15. In particular, since the lower end of the second wall 12 of the casing 15 is close to the outside air inlet 81, the air introduced from the outside air inlet 81 reaches the air inlet port 11H so as to mainly pass the lower side of the casing 15. Then, the blower fan 10 takes in the air into the casing 15 from the air inlet port 11H.

As shown in FIG. 5, the blower fan 10 takes in the air introduced into the space A1 from the space A2 in the housing 2 through the communication port 91, into the casing 15, through the air inlet port 11H.

At this time, the air flowing from the recess accommodating the sheet SH in the sheet tray 70 toward the communication port 91 circumvents the upper end 71T of the tray side wall 71 of the sheet tray 70 and reaches the communication port 91.

Then, the blower fan 10 discharges air from the air discharge port 13H toward the photosensitive member 5, the development roller 7A, the charger 7B, and so on, which are air blow targets. The discharged air is guided to the air duct 94 and flows into the four flow passages 7R through the four duct outlet ports 94H.

The air that has flowed into the flow passages 7R flows so as to remove heat and ozone accumulated around the chargers 7B, the photosensitive members 5, the development rollers 7A, and so on, and further, flows so as to be attracted to the negative pressure region generated at the rear side in the housing 2 by the operation of the first air discharge fan 82F. After the air passes through a dust filter and so on, the air is discharged to the outside of the housing 2 from the first outlet port 82.

<Operations and Effects>

In the image forming apparatus 1 of the embodiment, as shown in FIGS. 3 and 5, the outside air inlet 81 is located at a position different from the air inlet port 11H when viewed from the facing direction DF1. With this configuration, even if the rotation noise of the impeller 16 of the blower fan 10 leaks from the air inlet port 11H, most of the leaking rotation noise is likely to be blocked by the second wall 12 and the peripheral wall 13 of the casing 15 and the portions of the side cover 80 around the outside air inlet 81. Thus, the noise rarely leaks to the outside of the housing 2 through the outside air inlet 81.

Therefore, the image forming apparatus 1 of the embodiment suppresses the noise caused by the blower fan 10.

In the image forming apparatus 1, a portion of the casing 15 located below the air inlet port 11H and the outside air inlet 81 are located at overlapping positions when viewed from the facing direction DF1. With this configuration, the image forming apparatus 1 suppresses the path length from the outside air inlet 81 to the air inlet port 11H from becoming too long.

In the image forming apparatus 1, the outside air inlet 81 is located below the air inlet port 11H. With this configuration, in the image forming apparatus 1, when air entering the housing 2 from the outside of the housing 2 through the outside air inlet 81 flows upward and reaches the air inlet port 11H, foreign matter such as dust and dirt contained in the air is suppressed by the force of gravity from following the air flowing upward. As a result, in the image forming apparatus 1, the foreign matter contained in the air that has entered from the outside air inlet 81 is likely to drop to the bottom of the housing 2, and the foreign matter is prevented from reaching the air inlet port 11H.

In the image forming apparatus 1, as shown in FIG. 5, the first wall 11 has the air inlet port 11H, and the second wall 12 does not have the air inlet port 11H. With this configuration, even if the rotation noise of the impeller 16 of the blower fan 10 leaks from the air inlet port 11H, the leaking rotation noise must circumvent the peripheral wall 13 in order to reach the outside air inlet 81. Therefore, most of the leaking rotation noise is likely to be blocked by the second wall 12 and the peripheral wall 13 of the casing 15 and the portions of the side cover 80 around the outside air inlet 81, so that most of the leaking rotation noise rarely leaks to the outside of the housing 2 through the outside air inlet 81. As a result, the image forming apparatus 1 further suppresses the noise caused by the blower fan 10.

In the image forming apparatus 1, as shown in FIGS. 3 and 5, the communication port 91 of the frame 90 is located at a position overlapping the casing 15 when viewed from the facing direction DF1, and allows communication between the space A2 located at the sheet tray 70 side with respect to the frame 90 and the space A1 located at the blower fan 10 side with respect to the frame 90. With this configuration, since the blower fan 10 also takes in air from the space A2 through the communication port 91, the blower fan 10 efficiently blows air toward the photosensitive member 5, the development roller 7A, the charger 7B, and so on, which are air blow targets.

In the image forming apparatus 1, as shown in FIG. 5, the upper end 71T of the tray side wall 71 of the sheet tray 70 is located at a higher position than the upper end 91T of the communication port 91. With this configuration, dust such as paper dust adhering to the sheet SH accommodated in the sheet tray 70 is likely to be blocked by the tray side wall 71 even if the dust tries to move together with the air flowing from the space A2 toward the communication port 91. As a result, the image forming apparatus 1 suppresses the dust adhering to the sheet SH from reaching the air inlet port 11H through the communication port 91.

In the image forming apparatus 1, as shown in FIGS. 7 and 9, the urging portion 97 of the fan holding portion 95 contacts the peripheral wall 13 while being elastically deformed at a position away from the positioning shaft 99 and the positioning contact rib 98 to urge the casing 15 toward the positioning contact rib 98. Due to the urging portion 97, the image forming apparatus 1 suppresses the rattling of the casing 15.

In the image forming apparatus 1, as shown in FIG. 3, the air blow targets are the photosensitive member 5, the development roller 7A, the charger 7B, and so on. With this configuration, in the image forming apparatus 1, the blower fan 10 blows air to a region of the image forming unit 3 where heat is likely to accumulate for removing the heat and blows air to a region where ozone is likely to stay for removing the ozone. In this way, the image forming operation by the image forming unit 3 is stably executed.

While the disclosure has been described in detail with reference to the above aspects thereof, it would be apparent to those skilled in the art that various changes and modifications may be made therein without departing from the scope of the claims.

In the embodiment, the first wall 11 has the air inlet port 11H and the second wall 12 does not have the air inlet port 11H, but this disclosure is not limited to this configuration. For example, each of the first wall and the second wall may have an air inlet port. Alternatively, the second wall may have an air inlet port, and the first wall may not have an air inlet port.

In the embodiment, the fan holding portion 95 is formed integrally with the frame 90, but this disclosure is not limited to this configuration. For example, at least part of the fan holding portion may be a separate member from the frame. For example, in the embodiment, the urging portion 97 is formed integrally with the frame 90 which is made of resin. Alternatively, the urging portion may be a metal spring or other elastic material.

In the embodiment, the facing wall 95W of the frame 90 has the communication port 91. The blower fan 10 takes in air introduced from the recess accommodating the sheet SH in the sheet tray 70 into the space A1 through the communication port 91, through the air inlet port 11H, into the casing 15. However, this disclosure is not limited to this configuration. For example, the facing wall 95W may not have a through hole in the area overlapping the air inlet port 11H or the area overlapping the casing 15 when viewed from the facing direction DF1, and the blower fan 10 may not take in air from the recess accommodating the sheet SH. That is, the blower fan 10 may only take in the outside air from the outside air inlet 81.

This disclosure may be applied to, for example, an image forming apparatus or a multifunction peripheral.

What is claimed is:

1. An image forming apparatus comprising:

a housing including a side cover having an outside air inlet, the housing accommodating an air blow target; and a fan disposed to face the side cover in the housing, the fan being configured to introduce air and send the air toward the air blow target, the fan including:

an impeller; and a casing including a first wall covering the impeller, a second wall covering the impeller and facing the first wall, and a peripheral wall surrounding the impeller and connecting the first wall with the second wall, the peripheral wall having an air discharge port for discharging air toward the air blow target, the impeller being located between the first wall and the second wall, the second wall being located closer to the side cover than the first wall is, at least the first wall or the second wall having an air inlet port for introducing air into the casing, the outside air inlet being located at a different position from the air inlet port as viewed from a facing direction in which the fan and the side cover face each other, wherein the first wall has the air inlet port, and the second wall does not have the air inlet port.

2. The image forming apparatus according to claim 1, wherein a part of the casing and the outside air inlet overlap each other as viewed from the facing direction.

3. The image forming apparatus according to claim 1, wherein the outside air inlet is located at a lower position than the air inlet port.

4. The image forming apparatus according to claim 1, further comprising a fan holder holding the fan in the housing, the fan holder including:

a positioning shaft protruding in the facing direction and fitted in a positioning hole of the casing;

a positioning contact rib contacting the peripheral wall at a position separated from the positioning shaft, the positioning contact rib positioning the casing around the positioning shaft; and an urging portion contacting the peripheral wall to urge the casing toward the positioning contact rib while elastically deforming at a position separated from the positioning shaft and the positioning contact rib.

5. The image forming apparatus according to claim 1, further comprising an image forming unit configured to form an image on a sheet, the image forming unit including a photosensitive drum, a development roller, and a charger, wherein the air blow target includes at least the photosensitive drum, the development roller, or the charger.

6. The image forming apparatus according to claim 1, further comprising:

an air duct for sending air from the fan toward the air blow target; and a flow passage connecting the air duct and the air blow target, wherein the air discharge port is located at an upper side of the peripheral wall;

wherein the air duct extends upward from the air discharge port and turns to extend in a horizontal direction perpendicular to the facing direction; and wherein the flow passage extends in the facing direction at a side of the air blow target.

7. The image forming apparatus according to claim 4, further comprising:

a sheet tray configured to accommodate a sheet prior to image formation in the housing; and a frame located between the sheet tray and the fan in the housing, wherein the urging portion is an urging protrusion protruding from a main body of the frame.

8. An image forming apparatus comprising:

a housing including a side cover having an outside air inlet, the housing accommodating an air blow target and a fan disposed to face the side cover in the housing, the fan being configured to introduce air and send the air toward the air blow target, the fan including:

an impeller; and a casing including a first wall covering the impeller, a second wall covering the impeller and facing the first wall, and a peripheral wall surrounding the impeller and connecting the first wall with the second wall, the peripheral wall having an air discharge port for discharging air toward the air blow target, the impeller being located between the first wall and the second wall, the second wall being located closer to the side cover than the first wall is, at least the first wall or the second wall having an air inlet port for introducing air into the casing, the outside air inlet being located at a different position from the air inlet port as viewed from a facing direction in which the fan and the side cover face each other, wherein the image forming apparatus further comprises:

a sheet tray configured to accommodate a sheet prior to image formation in the housing; and a frame located between the sheet tray and the fan in the housing, wherein the frame has a communication port located at a position overlapping the casing as viewed from the facing direction; and wherein the communication port allows communication between a space located at a side of the sheet tray with respect to the frame and a space located at a side of the fan with respect to the frame.

9. The image forming apparatus according to claim 8, wherein the sheet tray includes a tray side wall facing the frame; and wherein an upper end of the tray side wall is located at a higher position than an upper end of the communication port.

10. The image forming apparatus according to claim 8, further comprising an air duct for sending air from the fan toward the air blow target, wherein the air duct is formed integrally with the frame.

11. The image forming apparatus according to claim 8, wherein the outside air inlet is located at a lower position than the air inlet port.

12. An image forming apparatus comprising:

a housing including a first side cover and a second side cover opposite to each other, the first side cover having an outside air inlet, the housing accommodating an air blow target; and a fan disposed to face the first side cover in the housing, the fan being closer to the first side cover than to the second side cover, the fan being configured to introduce air and send the air toward the air blow target, the fan including:

an impeller; and a casing including a first wall covering the impeller, a second wall covering the impeller and facing the first wall, and a peripheral wall surrounding the impeller and connecting the first wall with the second wall, the peripheral wall having an air discharge port for discharging air toward the air blow target, the impeller being located between the first wall and the second wall, the second wall being located closer to the first side cover than the first wall is, at least the first wall or the second wall having an air inlet port for introducing air into the casing, the outside air inlet being located at a different position from the air inlet port as viewed from a facing direction in which the fan and the first side cover face each other.

13. The image forming apparatus according to claim 12, wherein a part of the casing and the outside air inlet overlap each other as viewed from the facing direction.

14. The image forming apparatus according to claim 12, wherein the outside air inlet is located at a lower position than the air inlet port.

15. The image forming apparatus according to claim 12, wherein the first wall has the air inlet port, and the second wall does not have the air inlet port.

16. The image forming apparatus according to claim 12, further comprising a fan holder holding the fan in the housing, the fan holder including:

a positioning shaft protruding in the facing direction and fitted in a positioning hole of the casing;

a positioning contact rib contacting the peripheral wall at a position separated from the positioning shaft, the positioning contact rib positioning the casing around the positioning shaft; and an urging portion contacting the peripheral wall to urge the casing toward the positioning contact rib while elastically deforming at a position separated from the positioning shaft and the positioning contact rib.

17. The image forming apparatus according to claim 12, further comprising an image forming unit configured to form an image on a sheet, the image forming unit including a photosensitive drum, a development roller, and a charger, wherein the air blow target includes at least the photosensitive drum, the development roller, or the charger.

18. The image forming apparatus according to claim 12, further comprising:

an air duct for sending air from the fan toward the air blow target; and a flow passage connecting the air duct and the air blow target, wherein the air discharge port is located at an upper side of the peripheral wall;

wherein the air duct extends upward from the air discharge port and turns to extend in a horizontal direction perpendicular to the facing direction; and wherein the flow passage extends in the facing direction at a side of the air blow target.

* * * * *